United States Patent [19]

Ford

[11] Patent Number: 4,630,036

[45] **Date of Patent: * Dec. 16, 1986**

[54] EARLY WARNING OF MARINE COOLING SYSTEM FAILURE

[75] Inventor: John R. Ford, Xenia, Ohio

[73] Assignee: Vernay Laboratories, Inc., Yellow Springs, Ohio

[ * ] Notice: The portion of the term of this patent subsequent to Jul. 1, 2003 has been disclaimed.

[21] Appl. No.: 497,384

[22] Filed: May 23, 1983

Related U.S. Application Data

[63] Continuation-in-part of Ser. No. 461,081, Jan. 26, 1983.

[51] Int. Cl.[4] ..... G08B 21/00; G08B 23/00; H05B 6/06

[52] U.S. Cl. ..... 340/622; 123/41.05; 340/606; 340/608; 340/984; 440/2; 374/145; 374/148

[58] Field of Search ..... 340/599, 593, 584, 57, 340/52 R, 622, 984, 606–608; 307/310; 440/2; 210/85, 87, 108; 123/41.05; 374/144, 145, 147, 148

[56] References Cited

U.S. PATENT DOCUMENTS

| | | | |
|---|---|---|---|
| 2,957,348 | 10/1960 | Walker, Jr. | 374/145 |
| 3,343,004 | 9/1967 | Ovshinky | 307/310 |
| 3,475,745 | 10/1969 | White, Jr. | 340/622 |
| 3,860,837 | 1/1975 | Carlson | 307/310 |
| 3,864,260 | 2/1975 | Banner | 210/108 |
| 3,908,578 | 9/1975 | Buelk | 440/89 |
| 3,921,398 | 11/1975 | Kashmerick | 60/310 |
| 3,955,416 | 5/1976 | Waiwood | 340/622 |
| 4,036,162 | 7/1977 | Maier et al. | 440/56 |
| 4,078,531 | 3/1978 | Hewitt | 374/144 |
| 4,135,186 | 1/1979 | Minorikawa et al. | 340/622 |
| 4,160,733 | 7/1979 | Nelson | 210/85 |
| 4,196,361 | 4/1980 | Nakata | 307/310 |
| 4,278,970 | 7/1981 | Streczyn | 340/599 |
| 4,350,010 | 9/1982 | Yukishima | 60/310 |
| 4,364,226 | 12/1982 | Croset et al. | 374/144 |
| 4,556,330 | 12/1985 | Regtien | 307/310 |
| 4,564,834 | 1/1986 | Steele | 340/622 |
| 4,587,931 | 5/1986 | Duprez | 340/57 |

OTHER PUBLICATIONS

News release entitled "'Failsafe' Condition Monitoring System Fitted on SSV2", Joseph Lucas Ltd. of England, May 1972.

*Primary Examiner*—James L. Rowland
*Assistant Examiner*—Brent A. Swarthout
*Attorney, Agent, or Firm*—Biebel, French & Nauman

[57] ABSTRACT

An early warning system detects the failure of a marine cooling system by monitoring a resistance ground signal generated by a sensing element inserted into the cooling system. An alarm is given upon the detection of an increased resistance value of the resistance ground signal due to cessation or a severe reduction of water flow through the cooling system and hence contacting the sensing element. The sensing element is preferably inserted into the exhaust system portion of a marine engine cooling system and a detection circuit is connected to the sensing element. An alarm signal is generated by the detection circuit if insufficient water flow is present to maintain a low resistance value for the resistance ground signal generated by the sensing element. Such low resistance signal is maintained either by the electrical conduction of the water or the cooling effects of the water on the sensing element.

11 Claims, 6 Drawing Figures

EARLY WARNING OF MARINE COOLING SYSTEM FAILURE

BACKGROUND OF THE INVENTION

This application is a continuation-in-part of application Ser. No. 461,081 filed Jan. 26, 1983.

The invention relates to watercraft which rely upon a flow of water from an outside supply for cooling marine engines and associated equipment within the watercraft and, more particularly, to an alarm system for providing an early warning of the failure of a marine cooling system.

Watercraft which utilize internal combustion engines for propulsion and/or auxiliary purposes standardly use the water supporting the craft for cooling purposes. Water for circulation within a marine cooling system is pumped via an engine-driven water pump up through an open-ended water inlet conduit which extends into the water supporting the craft. The water may be circulated through a water jacket or manifold to absorb heat directly or the water may be circulated through heat exchangers which also receive engine coolant, gear lubricants, transmission fluid, or the like for indirect absorption of heat. In any event, once the water has absorbed heat generated by the engine, transmission, and/or other associated equipment, the water is returned to the body of water supporting the craft typically through an engine exhaust conduit.

All waterways include a certain amount of natural debris such as weeds, leaves, and the like, as well as unnatural debris such as plastic bags, paper, and the like. Accordingly, a coarse strainer is often provided across the open end of the water inlet to prevent large pieces of debris from entering the cooling system. While the coarse strainer prevents large pieces of debris from entering the cooling system, the strainer itself may become partially or totally blocked and prevent the proper flow of cooling water from entering the cooling system water inlet conduit.

Blockage of the strainer resulting in a cessation or severe reduction of the water flow through the water inlet conduit, and thereby the marine cooling system, eventually causes the marine engine and any associated equipment cooled by the cooling system to overheat. While the engine temperature is ordinarily displayed on a temperature gauge in the craft's cabin, oftentimes the gauge will go unnoticed permitting excessively high temperatures to develop.

Such high temperatures can not only ruin the engine, transmission, and/or associated equipment cooled by the cooling system, but can also start fires and burn holes in the manifold and/or exhaust system, which holes can permit dangerous fumes or water to enter the craft upon further operation. In large inboard boats, packing glands which seal the passage of propeller drive shafts through the hull may also be cooled by the cooling system. Failure of such glands due to overheating can result in sizeable holes surrounding the drive shafts and could sink a boat.

U.S. Pat. No. 4,160,733 and No. 3,864,260 disclose cleaning systems for marine engine cooling water inlets. The cleaning system of the former patent is activated manually or upon detection of an elevated engine temperature and the cleaning system of the latter patent is activated manually or in response to the activation of a vacuum switch which monitors the vacuum within the water inlet. While these patents appear to present viable cleaning systems, activation of a cleaning system upon detection of an elevated engine temperature may not prevent damage from overheating, and the use of a vacuum switch to monitor the water inlet presents complications and is less than absolutely reliable.

It is thus apparent that the need exists for a reliable, inexpensive, simply constructed early warning system for the detection of failures of marine cooling systems prior to the overheating of a marine engine or associated equipment cooled by the cooling system.

SUMMARY OF THE INVENTION

In accordance with the present invention, an early warning system is provided for detecting the failure of a marine cooling system wherein cooling water is drawn from the body of water supporting a watercraft utilizing a marine engine. Cooling water is drawn through a water inlet tube, circulated to cool the engine, and discharged back to the body of water through an engine exhaust conduit after having absorbed heat generated by operation of the engine. The early warning system detects a failure of the cooling system by monitoring a sensing element secured and extending into the exhaust conduit. The sensing element generates a low resistance ground signal during proper operation of the cooling system and an increased resistance signal exceeding a selected resistance value upon cessation or a severe reduction of the water flow through the cooling system. An alarm is given upon detection of the increased resistance signal.

According to one aspect of the present invention, an early warning system comprises a sensing element supported within the exhaust conduit of a marine engine for generating an increased resistance ground signal upon failure of the cooling system, circuit means connected to the sensing element for generating an alarm signal in response to the increased resistance signal, and alarm means responsive to the alarm signal for warning the operator of the watercraft of impending engine overheating. The water sensing element is preferably supported within the exhaust conduit of the marine engine into which cooling water is discharged; however, placement of the element within other portions of the cooling system which receive flowing water during proper cooling system operation is contemplated in accordance with one embodiment of the present invention.

In accordance with another aspect of the present invention, switch means are provided for disconnecting the sensing element from the circuit means whereby operation of the early warning system is conveniently checked by operation of the switch means.

One illustrative embodiment of the circuit means of the early warning system comprises an integrated threshold circuit having power and ground input terminals and an output terminal, and a resistor connected between the power input terminal and the control terminal, the sensing element then being connected to the junction of the resistor and the control terminal, and an alarm means connected to the output terminal. It is contemplated that either a visual or an audible alarm device, or preferably both, be utilized in accordance with the present invention.

The sensing element may comprise a threaded fastener having a noble metal head extending into the cooling system, preferably the exhaust conduit, with the fastener being insulated from and sealed into the cooling system and providing an electrical connection to the noble metal head external to the cooling system. The sensing element may alternately comprise a thermistor embedded within a probe secured and extending into the exhaust conduit of the marine engine.

For a threaded fastener sensing element, the presence of cooling water maintains a low resistance connection of the noble metal head to ground to generate a low resistance ground signal. Upon a failure of the cooling system, an increased ground signal is thus generated.

For a sensing element including a thermistor, one side of the thermistor is connected to ground and the presence of cooling water maintains the thermistor at a temperature below a critical point to generate a low resistance ground signal. Upon a failure of the cooling system, the temperature of the thermistor rapidly exceeds the critical point due to the hot exhaust gases to generate an increased resistance ground signal.

It is, therefore, an object of the present invention to provide an early warning system for detecting the failure of a marine cooling system by detecting cessation or severe reduction of water flowing through the cooling system.

It is another object of the present invention to provide an early warning system for detecting the failure of a marine cooling system by inserting a sensing element within an exhaust system of a marine engine served by the cooling system, monitoring the sensing element by circuit means connected thereto which generates an alarm signal if the resistance value of a resistance ground signal generated by the sensing element exceeds a selected resistance value, and providing alarm means responsive to the alarm signal for warning the operator of the watercraft utilizing the marine cooling system of impending overheating.

Other objects and advantages of the invention will be apparent from the following description, the accompanying drawings, and the appended claims.

DETAILED DESCRIPTION OF THE INVENTION

Figure 1:
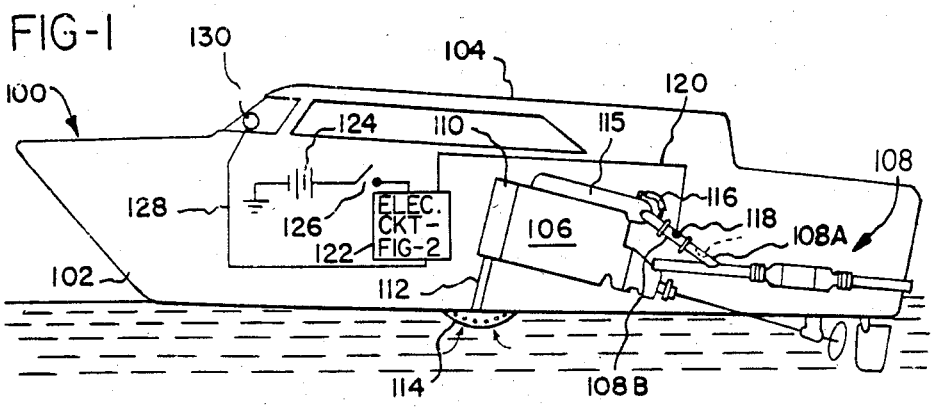
FIG. 1 is a schematic view of a watercraft showing an inboard marine engine incorporating an early warning system in accordance with the present invention.

The invention will now be described with reference to FIG. 1 which shows a watercraft 100 comprising a hull 102 and a cabin 104. The watercraft 100 is shown as an inboard pleasure boat having an inboard engine 106 and an exhaust system 108 connected thereto. It is noted, however, that the present invention is applicable to any marine engine, inboard, outboard, or inboard/-outboard, whether used for propulsion or for auxiliary purposes such as pumping water or generating electricity for use on the watercraft.

The inboard engine 106 drives a water pump 110 which draws engine cooling water through a water inlet conduit 112 from beneath the hull 102. Water enters the water inlet conduit 112 through a relatively coarse strainer 114 which prevents large debris from entering the inlet conduit 112 and clogging the internal passages of the cooling system for the engine 106.

Water is pumped through the water inlet 112 by the water pump 110 to a cooling manifold 115 which forms a portion of the engine 106 and ultimately exits through the exhaust system 108 by being injected thereinto through a small conduit 116. A sensing element 118 extends into the exhaust system 108 in a water-tight sealed engagement therewith. The sensing element 118 normally provides a low resistance ground signal due to the cooling water passing through the cooling system. Dependent upon the type of sensing element being utilized, the cooling water either provides a low resistance electrical connection of the sensing element to ground or cools the sensing element below a critical temperature of a thermistor embedded within the element as will become apparent.

Placement of the sensing element in the exhaust system is preferred since the hot exhaust gases quickly dry or heat the sensing element 118 to provide a more rapid warning upon cessation or severe reduction of the flow of cooling water. However, if a sensing element relying upon the electrical conductivity of the water is being utilized, it can also be placed within other portions of the cooling system which receive flowing water during normal operation of the cooling system and are above the water line or will otherwise be vacated upon cessation or a severe reduction of cooling water flow. An electrical conductor 120 extends from the sensing element 118 to circuit means 122, illustrative embodiments of which are shown schematically in FIGS. 2 and 4.

Electrical power is connected to the circuit means 122 from a boat battery 124 or other direct current (DC) voltage source through a contact 126 of an ignition switch which controls and starts the marine engine 106. The circuit means 122 generates an alarm signal which is passed via an electrical conductor 128 to alarm means 130 mounted within the cabin 104 of the watercraft 100. In accordance with the present invention, the alarm means 130 can be an audible alarm device or a visual alarm device or, preferably, a combination of the two.

Figure 3A:
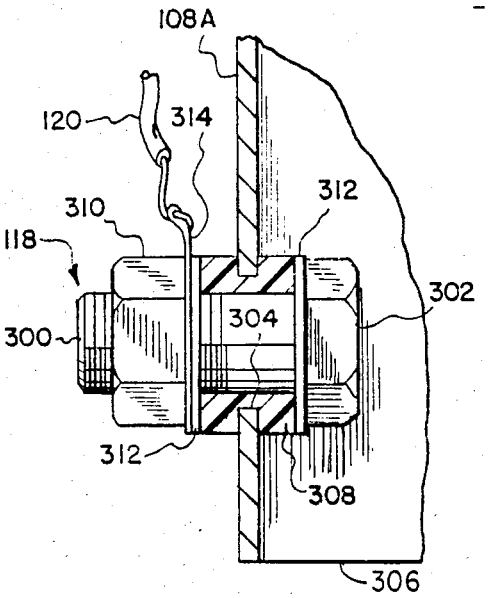
FIGS. 3A, 3B, and 3C are cross-sectional views through portions of the engine exhaust system of FIG. 1 showing illustrative sensing elements for use in the present invention.
Figure 3B:
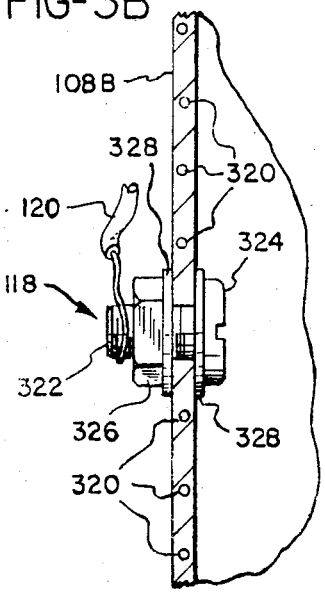
Figure 3C:
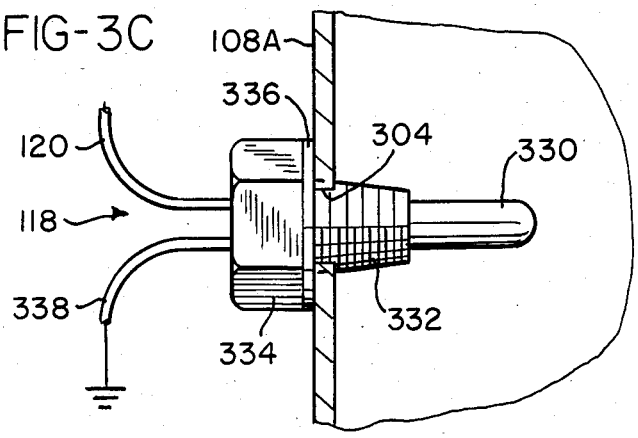

FIGS. 3A and 3B show two embodiments of sensing elements which rely on the electrical conductivity of the cooling water, and FIG. 3C shows an embodiment of a thermally controlled sensing element. In FIG. 3A, the sensing element 118 extends through a section of the exhaust conduit or pipe 108A of the exhaust system 108. As shown in FIG. 3A, the sensing element 118 comprises a bolt 300 having a noble metal head 302 which extends into the exhaust pipe 108A. The noble metal head 302 of the bolt 300 is electrically conducting yet resistant to the corrosive effects of the cooling water.

As shown in FIG. 3A, the bolt 300 may be conveniently inserted through a hole 304 formed in the side wall of the exhaust pipe 108A near an open end 306 which may be joined to adjacent sections of the exhaust system 108. The bolt 300 is insulated from the exhaust pipe 108A by means of a grommet 308 constructed from rubber or other electrically insulating material. It may be desirable to construct the grommet 308 from a heat-resistant material when the sensing element is located in the exhaust pipe 108A to ensure that it is not damaged by hot exhaust gases.

As shown in FIG. 3A, the bolt 300 is secured to the pipe 108A by means of a nut 310 and washers 312 positioned on either side of the grommet 308. An electrically conducting wire lug 314 is secured between the outer washer 312 and the nut 310 with the conductor 120 being secured to the lug 314 for electrical connection to the bolt head 302. Alternatively, the threaded shaft of the bolt 300 may be constructed of a material to which solder will adhere such that the conductor 120 may be directly wrapped and soldered to the threaded shaft of the bolt 300. This, as well as other alternative. electrical connections can be made to the noble metal head 302 of the bolt 300.

FIG. 3B shows an alternate embodiment/installation of an electrically conducting sensing element 118 in the exhaust system 108 when a flexible section 108B is included within the exhaust system 108. Such flexible sections are often included to prevent engine motion from being transmitted to the exhaust system. The flexible section 108B of the exhaust system may comprise a rubber hose reinforced by spiraling spring wire 320.

When such a flexible exhaust section is available, it is convenient to pierce the section and insert a screw 322 or other threaded fastener having a noble metal head 324 into the resulting hole. The screw 322 is secured to the flexible section 108B by a nut 326 and washers 328 such that the screw 322 is in watertight engagement with the flexible exhaust section 108B.

The location of the screw 322 in the flexible exhaust section 108B must be carefully selected to avoid potential grounding of the screw 322 through the reinforcing wire 320. The threaded portion of the screw 322 is shown as comprising solderable metal such that the conductor 120 is soldered to the threaded end exterior to the exhaust system 108.

FIG. 3C shows an alternate embodiment of a sensing element which is thermally controlled. As in FIGS. 3A and 3B, the sensing element 118 extends through a section of the exhaust system 108. As shown in FIG. 3C, the sensing element 118 comprises a thermistor sensor probe 330 formed, for example, from stainless steel with a thermistor 400, shown schematically in FIG. 4, embedded therewithin. The thermistor sensor probe 330 extends from a threaded element 332 which has a driving head 334 for engaging the threaded portion 332 into a hole 304 formed in the sidewall of the exhaust pipe 108A as previously described with reference to FIG. 3A. A sealing washer 336 may be utilized to ensure that the threaded member 332 is sealingly engaged into the hole 304 of the sidewall of the exhaust pipe 108A. Of course, a thermally controlled sensing element could also be mounted to the exhaust system 108 as shown in FIGS. 3A, 3B or in any other convenient manner.

Figure 4:
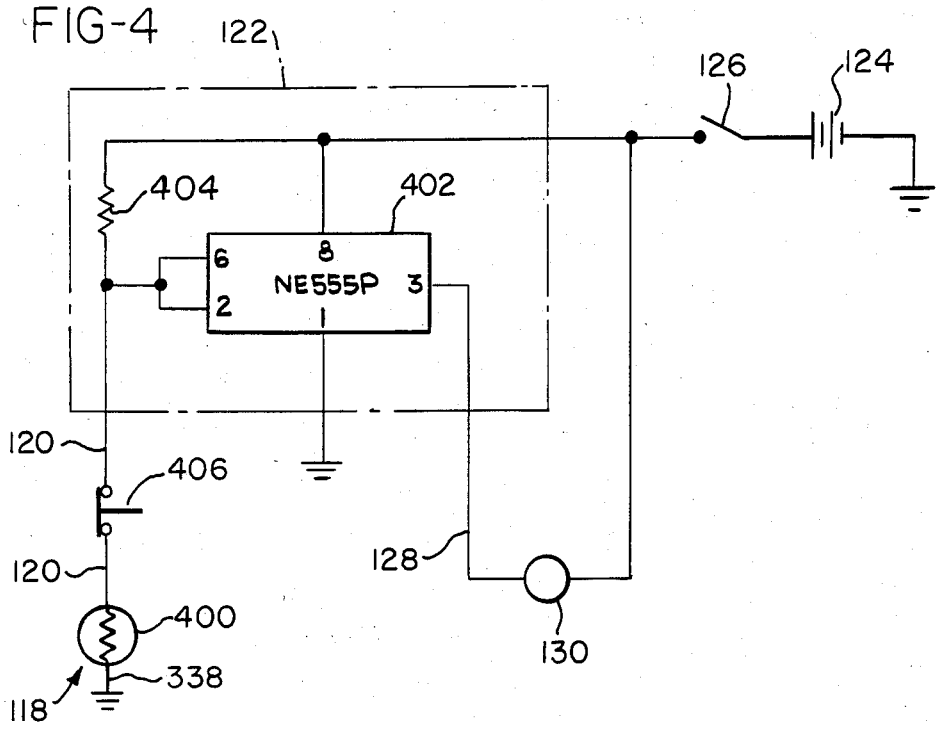
FIG. 4 is a schematic diagram of an alternate embodiment of circuit means for use in the early warning system of the present invention.

A thermistor 400, shown schematically in FIG. 4, is embedded into the probe 330 and includes a first conductor 338 which is connected to ground and a second conductor connected to the circuit means 122 via the conductor 120. For the thermally controlled sensing element shown in FIG. 3C, the resistance ground signal increases due to the effects of the thermistor embedded within the probe 330 upon the cessation or severe reduction in the flow of cooling water which maintains the temperature of the probe below a critical temperature during proper cooling system operation.

Figure 2:
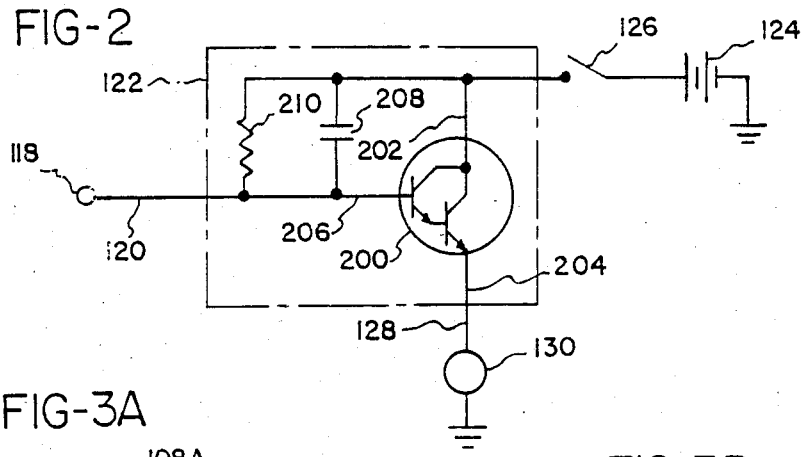
FIG. 2 is a schematic diagram of one embodiment of circuit means for use in the early warning system of the present invention.

FIG. 2 is a schematic diagram of one embodiment of the circuit means 122 of FIG. 1. In accordance with this embodiment, the circuit means is simply and inexpensively constructed from a darlington amplifier 200 having a power input terminal 202 connected to a contact 126 of the marine engine ignition switch, a power output terminal 204 connected to the alarm means 130 via the conductor 128, and a control terminal 206. A capacitor 208 and a resistor 210 are connected in parallel between the power input terminal 202 and the control terminal 206, with the control terminal 206 also being connected to the water sensing element 118 via the conductor 120. The capacitor 208 and the resistor 210 are selected to maintain the darlington amplifier 200 deactivated over pulses of water droplets resulting from anticipated reductions in the water flow, for example, due to reduced engine speed.

In accordance with one feature of the circuit shown in FIG. 2, the early warning system is self-checking. When the ignition switch is activated to start the marine engine 106, the darlington amplifier 200 is initially activated to pass an alarm signal to the alarm means 130. This initial activation is ensured by mounting the water sensing element 118 above the water line such that water is not initially contacting the sensing element 118, i.e., the sensing element is not grounded and, hence, provides an increased or high resistance ground signal.

As soon as the marine engine 106 drives the water pump 110 sufficiently to pump cooling water into the exhaust system 108 and the sensing element 118 is grounded thereby, the darlington amplifier 200 is deactivated so that the alarm signal passed via the conductor 128 to the alarm means 130 is extinguished. However, in the event that the flow of water through the cooling system ceases or is substantially reduced such that the sensing element 118 is ungrounded for a sufficient period of time as defined by the capacitor 208 and the resistor 210, the darlington amplifier 200 once again activates the alarm means 130.

FIG. 4 is the schematic diagram of an alaternate embodiment of the circuit means 122 of FIG. 1. In accordance with this embodiment, the circuit means is simply and inexpensively constructed from an integrated circuit 402. The integrated circuit 402 is a general purpose timer commercially available from Texas Instruments and identified as an NE555P. When the timer circuit is connected as shown in FIG. 4, it performs a threshold function indicative of the resistance value of the resistance ground signal generated by the sensing element 118 or thermistor 400 as shown in FIG. 4. Of course, other threshold circuits, both integrated and discrete, can be utilized in the present invention.

The integrated circuit 402 monitors the voltage level on the conductor 120 which is determined by the resistance value of the thermistor 400 and the resistor 404. For the schematic diagram shown in FIG. 4, the thermistor 400 is a positive temperature coefficient thermistor having a temperature response curve which is coordinated with the resistance value of the resistor 404 such that the voltage level on the conductor 120 exceeds the threshold value for activation of the integrated circuit 402 at a desired temperature. Once activated, the integrated circuit 402 in turn activates the alarm means 130 via the conductor 128 (assuming that the contact 126 of the marine engine has been closed). It is noted that a variety of temperatures can be selected for activation of the circuit by selection of the resistance value of the resistor 404, the thermistor 400 and/or the particular threshold circuit utilized.

In accordance with one feature of the circuit as shown in FIG. 4, switch means comprising a push-to-open switch 406 is inserted into the conductor 120 such that activation of the switch 406 will activate the alarm means 130 to verify proper operation of the system. The self-checking feature of the circuit shown in FIG. 2 would generally not operate when a thermistor sensing element is utilized since the thermistor would normally not be at or above the critical temperature required to activate the integrated circuit 402. Accordingly, the push-to-test feature provided by the switch 406 in the circuit of FIG. 4 could also be used in the circuit of FIG. 2 when a thermistor sensing element is utilized with that circuit.

If the push-to-test feature is utilized, it may be desirable to disable the self-checking operation of the circuit of FIG. 2. Such disabling could be by a delay of the connection of power through the contact 126 until water was flowing through the cooling system or in any other convenient manner.

The invention thus provides an early warning system of impending overheating of the engine 106 and any associated equipment cooled by the cooling system as soon as a lack of cooling water flow in the cooling system, preferably the engine exhaust system 108, is detected. Early corrective measures can then be taken to prevent the marine engine 106 and associated equipment from overheating and thereby prevent potential damage to the engine, transmission, boat, cooling system, and, of course, occupants of the boat.

While the forms of apparatus herein described constitute preferred embodiments of this invention, it is to be understood that the invention is not limited to these precise forms of apparatus and that changes may be made therein without departing from the scope of the invention, which is defined in the appended claims.

What is claimed is:

1. In a marine cooling system wherein cooling water is drawn from the body of water supporting a watercraft utilizing a marine engine, said water being drawn through a water inlet, circulated to cool said engine, and discharged back to said body of water through an exhaust conduit of said engine, an early warning system for detecting the failure of said marine cooling system comprising:

a temperature sensing element presenting an electrical resistance which varies with temperature supported within said exhaust conduit, said sensing element being cooled by said water as it is discharged through said exhaust conduit to provide a connection to ground potential through the resistance of said sensing element thereby defining a resistance ground signal having a low resistance value during proper operation of said cooling system and rapidly rising in temperature to provide an increased resistance value upon failure of said cooling system;

circuit means connected to said sensing element for generating an alarm signal in response to a resistance ground signal having an increased resistance value exceeding a selected resistance value; and alarm means responsive to said alarm signal for warning the operator of said watercraft of impending engine overheating.

2. An early warning system as claimed in claim 1 further comprising switch means for disconnecting said sensing element from said circuit means whereby operation of said early warning system is conveniently checked by operation of said switch means.

3. An early warning system as claimed in claim 2 wherein said circuit means comprises:

an integrated threshold circuit having power and ground input terminals, an output terminal, and a control terminal; and a resistor connected between said power input terminal and said control terminal, said sensing element being connected to the junction of said resistor and said control terminal, and said alarm means being connected to said output terminal.

4. An early warning system as claimed in claim 3 wherein said temperature sensing element comprises a threaded fastener having a noble metal head secured into said exhaust system, said fastener being insulated from and sealed into said exhaust system and providing an electrical connection to said noble metal head external to said exhaust system.

5. An early warning system as claimed in claim 4 wherein said alarm means comprises a visible alarm device.

6. An early warning system as claimed in claim 4 wherein said alarm means comprises an audible alarm device.

7. An early warning system as claimed in claim 4 wherein said alarm means comprises a visible alarm device and an audible alarm device.

8. An early warning system as claimed in claim 3 wherein said temperature sensing element comprises a thermistor embedded within a probe secured and extending into said exhaust system.

9. An early warning system as claimed in claim 8 wherein said alarm means comprises a visible alarm device.

10. An early warning system as claimed in claim 8 wherein said alarm means comprises an audible alarm device.

11. An early warning system as claimed in claim 8 wherein said alarm means comprises a visible alarm device and an audible alarm device.

* * * * *